US012049767B2

(12) United States Patent
Meyer et al.

(10) Patent No.: US 12,049,767 B2
(45) Date of Patent: Jul. 30, 2024

(54) FENCE/RAILING/GATE ELEMENT

(71) Applicant: BeGlobal Holdings GmbH, Oyten (DE)

(72) Inventors: Benjamin Meyer, Oyten (DE); Dietmar Meyer, Oyten (DE)

(73) Assignee: BeGlobal Holdings GmbH, Oyten (DE)

( * ) Notice: Subject to any disclaimer, the term of this patent is extended or adjusted under 35 U.S.C. 154(b) by 0 days.

(21) Appl. No.: 16/965,365

(22) PCT Filed: Feb. 22, 2019

(86) PCT No.: PCT/EP2019/054496
§ 371 (c)(1),
(2) Date: Jul. 28, 2020

(87) PCT Pub. No.: WO2019/162474
PCT Pub. Date: Aug. 29, 2019

(65) Prior Publication Data

US 2021/0123241 A1 Apr. 29, 2021

(30) Foreign Application Priority Data

Feb. 23, 2018 (DE) ..... 20 2018 101 013.1

(51) Int. Cl.
*E04H 17/14* (2006.01)
*E04F 11/18* (2006.01)

(52) U.S. Cl.
CPC .. *E04H 17/1417* (2013.01); *E04F 2011/1831* (2013.01); *E04F 2011/1872* (2013.01); *E04H 17/1447* (2021.01)

(58) Field of Classification Search
CPC ..... E04H 17/1417; E04H 17/1426; E04H 17/143; E04H 17/1439; E04H 17/1447;
(Continued)

(56) References Cited

U.S. PATENT DOCUMENTS 5,131,630 A * 7/1992 Nash ..... E01F 7/02 256/12.5
5,255,897 A * 10/1993 Pepper ..... E04H 17/1417 256/24

(Continued)

FOREIGN PATENT DOCUMENTS

DE 75 29 021 U1 7/1978
DE 82 24 156 U1 11/1982

(Continued)

OTHER PUBLICATIONS

English translation of the International Preliminary Report on Patentability in PCT/EP2019/054496 and the Written Opinion of the International Searching Authority, dated Aug. 27, 2020.

(Continued)

*Primary Examiner* — Josh Skroupa
*Assistant Examiner* — Kevin J Baynes
(74) *Attorney, Agent, or Firm* — Collard & Roe, P.C.

(57) ABSTRACT

The invention relates to a fence/railing/gate element comprising a base frame (16) that has a multiplicity of vertical bars (18; 18') connected to a lower support profile (20; 20'; 20''; 20'''; 2''''), wherein the lengths of the vertical bars (18; 18') are greater than the horizontal distance between two adjacent vertical bars (18; 18'). In order to extend the possible uses of such elements, it is provided according to the invention that between two adjacent vertical bars (18; 18'), in each case one flat filling element (24; 24') is inserted for filling the space between two adjacent vertical bars (18; 18'), the height of which filling element—measured in the direction of the longitudinal extent of the lower support profile (20; 20'; 20''; 20'''; 20'''')—is greater than its width, wherein the support profile (20; 20'; 20''; 20'''; 20'''') is arranged vertically below the filling elements (24; 24') and (Continued)

the region vertically above the filling elements (24; 24') is open.

14 Claims, 4 Drawing Sheets

(58) Field of Classification Search
CPC ..... E04H 17/20; E04F 11/1853; E04F 2011/1831; E04F 2011/1872
See application file for complete search history.

(56) References Cited

U.S. PATENT DOCUMENTS

| | | | | |
|---|---|---|---|---|
| 6,039,307 | A * | 3/2000 | De Zen | E04H 17/143 256/19 |
| 7,441,919 | B2 * | 10/2008 | Sheridan | E04F 11/18 362/151 |
| 2008/0099751 | A1 * | 5/2008 | Chen | E04H 17/00 256/19 |
| 2012/0319067 | A1 | 12/2012 | Millar et al. | |
| 2013/0128591 | A1 * | 5/2013 | Bennette | F21V 33/006 362/311.02 |
| 2015/0041743 | A1 * | 2/2015 | Richison | E04H 17/1417 256/24 |
| 2015/0345173 | A1 | 12/2015 | Grasman | |
| 2016/0042618 | A1 | 2/2016 | Kemp et al. | |
| 2016/0244992 | A1 | 8/2016 | Presti | |
| 2016/0298356 | A1 * | 10/2016 | Fletcher | E04H 17/1447 |
| 2016/0298357 | A1 * | 10/2016 | Liu | E04H 17/1417 |
| 2017/0183890 | A1 * | 6/2017 | Liu | E04H 17/1417 |

FOREIGN PATENT DOCUMENTS

| | | | | |
|---|---|---|---|---|
| DE | 297 21 660 | U1 | 2/1998 | |
| DE | 20 2005 003 464 | U1 | 7/2005 | |
| DE | 20 2008 016 039 | U1 | 2/2009 | |
| DE | 20 2009 014 463 | U1 | 2/2010 | |
| DE | 20 2010 005 796 | U1 | 8/2010 | |
| FR | 3024488 | B1 * | 8/2017 | E04F 11/1842 |
| WO | WO-2009025626 | A1 * | 2/2009 | E04H 17/1448 |
| WO | WO-2010087697 | A1 * | 8/2010 | E04H 17/1452 |

OTHER PUBLICATIONS

International Search Report in PCT/EP2019/054496, mailed Jun. 17, 2019.

German Search Report in DE 20 2018 101 013.1, dated Nov. 2, 2018, with English translation of relevant parts.

* cited by examiner

FENCE/RAILING/GATE ELEMENT

CROSS REFERENCE TO RELATED APPLICATIONS

This application is the National Stage of PCT/EP2019/054496 filed on Feb. 22, 2019, which claims priority under 35 U.S.C. § 119 of German Application No. 20 2018 101 013.1 filed on Feb. 23, 2018, the disclosure of which is incorporated by reference. The international application under PCT article 21(2) was not published in English.

BACKGROUND OF THE INVENTION

1. Field of the Invention

The invention relates to a fence/railing/gate element, and a fence, railing or gate with such an element.

The invention concerns fences for enclosing property, gates, including portals, and railings, such as balcony railings and stair railings. In particular, fences and railings are constructed from individual elements, i.e. fence or railing elements. The invention therefore concerns in particular these fence or railing elements. However, the invention can also be applied to gate elements, in particular the movable part of a gate.

2. Description of the Related Art

Known fence/railing/gate elements have a base frame comprising a multiplicity of vertical bars connected to a lower support profile. Typically, the lengths of the vertical bars are greater than the horizontal distance between two adjacent vertical bars.

Fences with such elements are known, for example, as metal picket fences.

However, the application possibilities and intended uses of such fences are limited. In particular, they are not suitable for privacy protection.

SUMMARY OF THE INVENTION

It is therefore an object of the invention to expand the possible applications of the elements used for such conventional fences and to provide a fence formed from such elements and a railing formed from such elements, respectively.

The invention achieves this object with the features of a fence/railing/gate element according to one aspect of the invention and with a fence, railing or gate with the features according to another aspect of the invention.

The fence/railing/gate element according to the invention comprises a base frame having a multiplicity of vertical bars connected to a lower support profile, wherein the lengths of the vertical bars are greater than the horizontal distance between two adjacent vertical bars, wherein between two adjacent vertical bars in each case one flat filling element is inserted for filling the space between two adjacent bars, the height of which is greater than its width—measured in the direction of the longitudinal extent of the support profile, wherein the support profile is arranged vertically below the filling elements and the entire region vertically above the filling elements is open.

According to the invention, an element with a closed appearance can be provided in this manner, so that a fence formed from such elements is suitable as a privacy fence and/or as wind protection.

Moreover, a correspondingly formed element is suitable in an analogous manner as a balcony railing or stair railing as well as for providing gates or portals.

Furthermore, such an element provides improved safety, in particular improved fall protection, since the distances between vertical bars—unlike conventional fences—are closed so that neither animals can get through the vertical bars and possibly fall, nor people, in particular children, can get their limbs stuck between vertical bars and possibly injure themselves.

The fence, railing or gate element according to the invention is installed according to the invention in a fence, railing or gate, each fence or railing element being attached between two posts provided laterally of each of these elements.

The base frame and the filling elements are preferably made of different materials. For example, the base frame is made of steel and optionally hot-dip galvanized and may be additionally powder-coated, if necessary, while the filling elements are made of wood. Preferably, thermally modified spruce is used for such wooden filling elements.

The use of two different materials allows for a varied appearance, for example with a mix of steel and wood, which either blends in particularly well with its surroundings or stands out from its surroundings in an accentuated manner.

In an alternative configuration of the invention, the base frame and the filling elements are made of the same materials. The use of the same materials enables a uniform appearance with a uniform overall impression.

However, within the scope of a further development of the invention there is also the possibility of providing different surfaces despite the use of two identical materials. For example, the base frame can be made of powder-coated stainless steel while the filling elements are made of polished stainless steel. Alternatively, the base frame is coated with a different color than the filling elements. In this way, different visual impressions of the base frame and the filling elements can be achieved despite the use of the same materials.

A further development of the invention provides that the material of the base frame is or includes steel, stainless steel, aluminum, plastics, metal, composite material, bamboo or, respectively, bamboo-plastic composite material or wood or, respectively, wood-plastic composite material. Preferably, the base frame is made of powder-coated galvanized steel or powder-coated aluminum. Accordingly, it is intended that the material of the filling is or includes wood, glass, aluminum, plastics or bamboo or, respectively, bamboo-plastic composite material or wood or, respectively, wood-plastic composite material. Preferably, the material of the filling is or includes: HPL (High Pressure Laminate—laminate in sheet form, preferably made of several layers of paper and resin using the high-pressure pressing method), one or more pure plastics, such as acrylic glass, recycled plastics, etc., rock or stone materials, such as fiber cement, concrete, ceramics, slate, etc., and/or carbon material, such as carbon.

According to a further development of the invention, above the lower support profile, horizontal connecting bars are attached to the vertical bars by means of which the vertical bars are connected to each other. The horizontal connecting rods advantageously prevent the filling elements from tilting to the side and therefore hold the filling elements in position.

According to a further development of the invention, sealing material and/or rubber elements are arranged between the horizontal connecting bars and the filling elements. A further development of the invention also provides that sealing material and/or rubber elements are arranged between the vertical bars and the filling elements. As a result, a stabilization of the filling elements is achieved and, furthermore, a movement and in particular a rattling of the filling elements is avoided.

According to a further development of the invention, the vertical bars have grooves for guiding the filling elements, wherein the widths of the grooves are adapted to the thickness of the filling elements. The grooves prevent the filling elements from tilting to the side and ensure that they remain in position.

A further development of the invention provides that the grooves are provided with sealing material and/or rubber elements. This also ensures that a stabilization of the filling elements is achieved and a movement, in particular a rattling of the filling elements is prevented. In addition, such grooves make it possible to eliminate the horizontal connecting bars. This means that in the case of such a construction, the fence/railing/gate element is or can be formed without horizontal connecting bars.

According to a further development of the invention, the lower support profile, the vertical bars and/or the horizontal connecting bars are provided with light sources, e.g. LED strips. As far as the filling elements are made of translucent materials, e.g. glass, the light sources cause the filling elements to glow. In such a configuration, the glass filling elements are preferably coated with matt white foil or sandblasted. Additionally or alternatively, the glass filling elements can be printed using the screen printing method, e.g. ceramic screen printing, wherein a dot matrix is preferably printed thereon. If the filling elements printed in this way are illuminated by the aforementioned light sources or LED strips by lateral irradiation of one edge or side surface of the filling elements, the glass filling elements glow homogeneously. If the filling elements are made of opaque materials, they are illuminated on one or both sides by the light sources.

According to a further development of the invention, the lower support profile is formed as a rectangular tube with slots extending in the longitudinal direction of the tube and arranged on the upper side thereof in the region of translucent filling elements, and is in particular made of glass, preferably frosted glass, or plastics. The light sources are preferably LED strips which are arranged within the lower support profile in the region of the slots. The LED strips are preferably arranged exclusively in the region of the slots.

In this way, light can be fed in via the lower narrow sides of translucent filling elements, which light is diffusely scattered on the surface of the translucent filling elements. This causes the filling elements to glow over their entire surfaces.

The translucent filling elements either rest on the slots or are inserted into the slots. When the filling elements are inserted into the slots, this results is the advantage that the filling elements are not damaged because the filling elements protruding into the support profile achieve a higher stability and better illumination is achieved while avoiding scattered light. Preferably, the LED strips are mounted on a plastic body, in particular a PVC tube, which is inserted in the longitudinal direction of the lower support profile. This is advantageous in order to attach the LED elements as close as possible to the respective slots.

Such light sources are advantageous in particular in connection with the aforementioned screen printing method in which the glass filling elements are printed with a dot matrix, for example, by ceramic screen printing.

According to a further development of the invention, LED modules are provided as light sources by means of which each filling element is separately supplied with light and the light sources of each filling element are controlled separately.

Preferably, the LED modules are connected to a control module which can control the LED modules individually, wherein the control module is connected to the Internet via WLAN (Wireless Local Area Network). In this way, the control module is remotely controlled via smartphone app or tablet app. By means of this app, the user can control the filling elements individually or in groups, preferably with regard to the light color and/or light intensity and/or color changes that take place over time, or different color tones of adjacent filling elements, so that a color change takes place over the location, so that, for example, the colors of adjacent filling elements change rainbow-like over the location.

According to a further development of the invention, the LED modules are formed in such a way that an LED strip is inserted into a C-profile and potted with epoxy resin. This provides for a special mechanical protection and protection against moisture for the LED elements.

Preferably, the LED modules are designed with a length corresponding to the width of a filling element plus the width of a vertical bar. Preferably, the LED modules are configured such that they can be plugged together. Thus, the length of the light source can advantageously be adapted to the width of the fence/railing/gate element by simply plugging together the number of LED modules corresponding to the number of filling elements and inserting them into the support profile.

According to a further development of the invention, the glass filling elements have a laser engraving. In this way, for example, company logos, house numbers or other symbols, in particular characters and numbers, can be displayed in a luminous manner.

According to a further development of the invention, holes are provided between the slots. Excess material is discharged via these holes during a galvanizing process.

A further development of the invention provides that the lower support profile is an extruded profile, preferably made of aluminum, with two portions lying one above the other, the upper portion being formed as a rectangular tube with slots extending in the longitudinal direction of the tube and arranged on its upper side, and the lower portion being formed as a channel for accommodating electrical cables. Thus, if necessary, electrical lines can be accommodated in this channel.

It is possible, for example, to supply electricity to sensors, e.g. motion detectors, in the fence/railing/gate via electrical lines laid in such a channel and to supply data to the control module and/or another control device via such lines. This enables the fence/railing/gate to interact with its surroundings. For example, when a person or vehicle approaches, sensors can send detection signals to the control module or control device, which, for example, controls the light sources so that they illuminate or glow more brightly and/or to generate light effects, such as running lights. In this way, for example, a path extending along a fence can be illuminated when a person walks along this path. A gate can also start to light up when a person approaches it, e.g. to make it easier for the person by means of illumination to unlock the gate and/or to illuminate the person so that the person can be better recognized by or by means of a camera.

In a further development of the invention, the control module or control device is designed to retrieve weather data via the Internet connection in order to influence the colors of the light sources depending on the weather data, e.g. the outside temperature and/or any precipitation in the form of rain or snow. Thus, for example, in the cold season or when snow falls, the fence may glow in bluish colors, while during the warmer summer months it may glow in green shades and during the autumn season in yellow, orange or brown shades.

Preferably, sensors, including cameras, for detecting burglaries are used as sensors so that the fence or railing or gate is provided with burglar alarm functions.

According to a further development of the invention, the lower support profile has further slots on its underside. Advantageously, rainwater can drain off through these additional slots.

A further development of the invention provides that there is a distance between the two outer vertical bars and the respective nearest end of the lower support profile which corresponds to the distance between two vertical bars. In this construction, the outer panel elements are only bounded on one side by a vertical bar and can be bounded on the other side of the panel element by a post. As a result of this construction, two vertical bars per fence/railing/gate element and thus material and weight can be saved.

According to an alternative further development of the invention, the two outer vertical bars are fastened to the respective ends of the lower support profile. Such a construction is of advantage in particular in the case of gates. Specifically, this construction also allows a reliable fastening of the outer panel elements.

A further development of the invention provides that the vertical bars, the lower support profile and/or the horizontal connecting bars are formed round, angular or as a special profile as hollow body or solid made of solid material. The use of hollow bodies is advantageous with regard to the reduction of material, weight and thus costs. The use of solid material corresponds to historical building techniques and is particularly durable. The use of special profiles effects an increase in stability; this in turn enables thinner wall thicknesses and thus savings in material, weight and thus costs.

A further development of a fence or railing according to the invention provides that the posts each have base plates. Such base plates are advantageous because they enable the fence or railing to stand securely without being anchored in the ground solely because of the dead weight of the fence or railing.

According to a further development of the invention, solar cells are provided on the fence/railing/gate, in particular on the posts thereof. In this way, the electrical elements on the fence/gate/railing can be supplied with power and electrical energy independently.

Further developments of the invention arise from the claims, the description and the drawings. The aforementioned advantages of features and of combinations of a plurality of features are exemplary and can take effect alternatively or cumulatively without the advantages necessarily having to be obtained from embodiments according to the invention. Further features are apparent from the drawings—in particular the geometries shown and the relative dimensions of several components to each other as well as their relative arrangement and operative connection. The combination of features of different configurations of the invention or of features of different claims is also possible in deviation from the selected related claims and is hereby proposed. This also applies to features which are illustrated in separate drawings or which are mentioned in the description. These features can also be combined with features of different claims. Likewise, features listed in claims may be omitted for further embodiments of the invention.

DETAILED DESCRIPTION OF THE PREFERRED EMBODIMENTS

Figure 1:
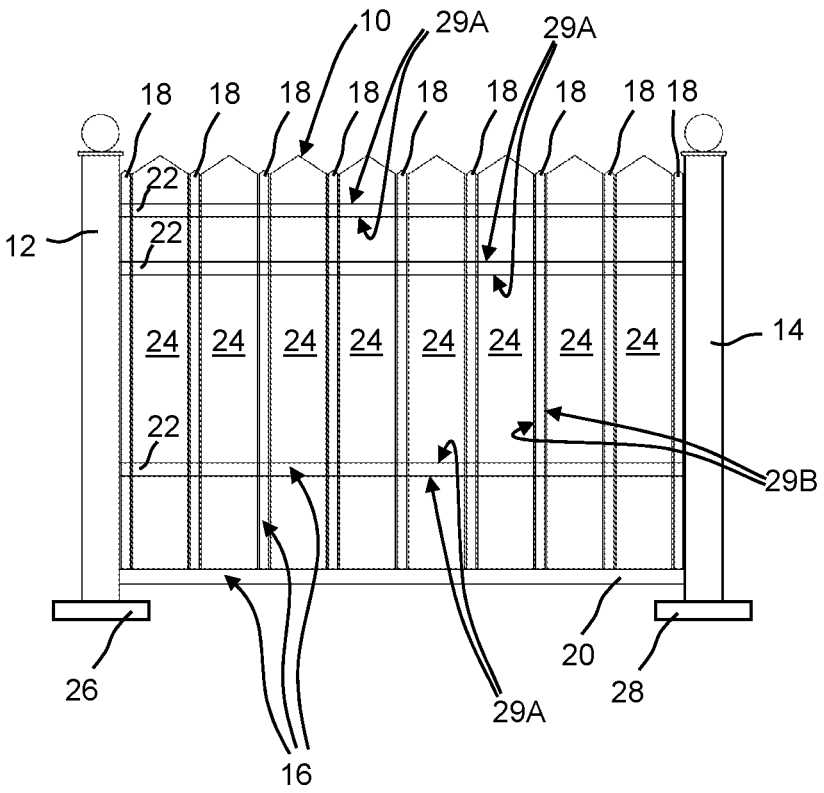
FIG. 1 shows an exemplary embodiment of a fence/railing/gate element according to the invention, arranged between two posts in a side view.

FIG. 1 shows an exemplary embodiment of a fence/railing/gate element 10 according to the invention, which is arranged between two posts 12, 14.

The fence/railing/gate element 10 comprises a base frame 16, which comprises a multiplicity of vertical bars 18, which are connected to a lower support profile 20. The vertical bars 18 can be formed round, square or with a different cross-section, namely as a hollow profile or made from solid material. Likewise, the lower support profile 20 can be formed round, square or with a different cross-section, namely as a hollow profile or made from solid material. The configuration of the vertical bars 18 and the configuration of the lower support profile 20 are independent of each other.

The connection between vertical bars 18 and the lower support profile 20 can be implemented in different ways. In particular, this concerns a welded connection, screw connection, rivet connection, clamp connection, adhesive connection or a plug connection. However, the connection can also be made by pushing matching profiles into each other.

The vertical bars 18 are arranged spaced apart from each other on the lower support profile 20. The distances between two adjacent vertical bars 18 are significantly smaller than the lengths of the vertical bars 18. Preferably, the distances are selected to be the same.

According to a preferred embodiment, the vertical bars can be connected to one or more horizontal connecting bars 22 for stabilization and visual enhancement.

The horizontal connecting rods 22 can again be round, angular or also formed with a different cross-section, namely again as a hollow profile or made from solid material. The configuration of the horizontal connecting bars 22 in turn is independent of the configuration of the vertical bars 18 and the configuration of the lower support profile 20.

The connection between the horizontal connecting bars 22 and the vertical bars 18 can also be established by welding, screwing, riveting, clamping, gluing or by inserting or pushing them into each other.

The base frame 16 is thus formed by the lower support profile 20, the vertical bars 18 and the horizontal connecting bars 22.

The base frame 16 is preferably made of steel, in particular hot-dip galvanized and/or powder-coated steel, stainless steel, in particular powder-coated stainless steel, aluminum, in particular powder-coated aluminum or plastics. Alternatively, the base frame 16 is made of wood or wood-plastic composite materials, in particular bamboo or, respectively, bamboo-plastic composite materials.

The base frame 16 can also have a surface finish which is formed by painting, sealing, burnishing and anodizing, for example.

Between each two adjacent vertical bars 18, one flat filling element 24 is inserted to fill the space between two adjacent vertical bars 18. The height of the filling elements 24 is greater than the width of the filling elements 24 measured in the direction of the longitudinal extent of the lower support profile 20. This gives the filling elements 24 an elongated appearance. The filling elements 24 are aligned in such a manner that their long side is vertical.

The base frame 16 is constructed in such a manner that these filling elements 24 can be inserted vertically from above into the spaces between two adjacent vertical bars 18.

Advantageously, the base frame 16—as well as the filling elements 24—have already been manufactured in the production plant. When erecting a fence, railing or gate, the base frame 16 is erected first between the posts 12, 14 and attached thereto and in a second step, the filling elements 24 are integrated in the base frame 16.

This two-stage construction allows a weight reduction of the fence panels or railing panels to be erected. This is advantageous so that a fence or railing can be erected with the strength of one or two persons alone without the need of large machines.

Attaching the fence/railing/gate elements 10 to the posts 12, 14 is preferably carried out with screws. Alternatively, fastening can be carried out by riveting, gluing, clamping, sliding into each other or welding.

The posts 12, 14 can be made of steel, in particular hot-dip galvanized and/or powder-coated steel, stainless steel, in particular powder-coated stainless steel, aluminum, in particular powder-coated aluminum, or plastics, or of wood or, respectively, wood-plastic composite materials, in particular bamboo, or, respectively, bamboo-plastic composite materials. In addition, the posts 12, 14 may be provided with a surface finish, e.g. by painting, sealing, burnishing or anodizing.

The posts 12, 14 are either anchored in the ground or subsoil, e.g. by burying, setting in concrete or screwing onto masonry or a foundation, a concrete slab or stairs. In particular in the case of screwing, the posts 12, 14 are provided with base plates 26, 28.

Thanks to the base plates 26, 28 on the posts 12, 14 it is also possible to install a fence or railing without anchoring, wherein the fence or the railing will remain standing due to its dead weight.

The filling elements 24 are preferably made of wood, glass, aluminum, plastics or wood or, respectively, wood-plastic composite materials, in particular bamboo or, respectively, bamboo-plastic composite materials.

Moreover, filling elements 24 can also be formed by means of textiles or fabrics. In a particular embodiment, such textiles or fabrics are advantageously stretched onto a frame.

The filling elements 24 either rest directly on the lower support profile 20 or are arranged spaced apart from the lower support profile. The first case is advantageous if a privacy screen and/or wind protection reaching down to the ground is to be provided. In this case, it is even possible to insert filling elements 24 into the lower support profile 20, for which purpose the lower support profile 20 accordingly has a groove, for example. The second case is advantageous if permanent moisture in the region between the lower support profile 20 and the filling elements 24 is to be avoided, for example if the filling elements 24 are made of wood or other materials that are sensitive to moisture.

The vertical bars 18 and optionally additional horizontal connecting bars 22 prevent the filling elements 24 from tilting sideways, i.e. to the right or left and backwards or forwards.

In addition, sealing material 29A, 29B and/or rubber elements 29A, 29B may be placed between the horizontal connecting bars 22 (as sealing material 29A and/or rubber elements 29A) and/or the vertical bars 18 (as sealing material 29A and/or rubber elements 29A) and the filling elements 24 to further stabilize the filling elements 24 and to prevent movement, in particular rattling.

According to a particular further development of the invention, one or more light sources, such as LED strips, are located on the base frame 16, preferably on or along the lower support profile 20. Such light sources make it possible to light up translucent materials as filling elements 24, such as glass, for example. If, on the other hand, the filling elements 24 are made of opaque materials, the light sources are arranged on the base frame 16 in such a manner that the fence/railing/gate element 10 can be illuminated either on one side or on both sides.

Additionally or alternatively, it is possible to arrange the light sources on the vertical bars 18 and/or on the horizontal connecting bars 22.

Figure 2:
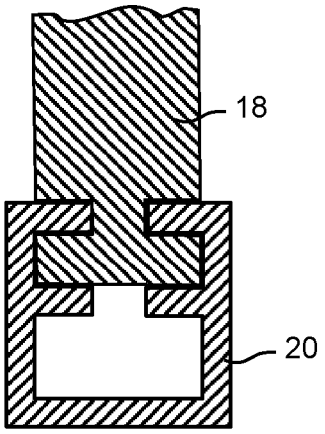
FIG. 2 shows a lateral sectional view of an enlarged detail in the region of the connection between the lower support profile and a vertical bar of the fence/railing/gate element shown in FIG. 1.

FIG. 2 shows a possibility of connecting a vertical bar to the lower support profile 20 according to an exemplary embodiment of the invention. In this example, the vertical bars 18 are inserted laterally into the support profile 20. The vertical bars 18 and the support profile are matched to each other in such a manner that a form fit is achieved. The selected profiles and shapes are only examples; various variants are possible.

Figure 3:
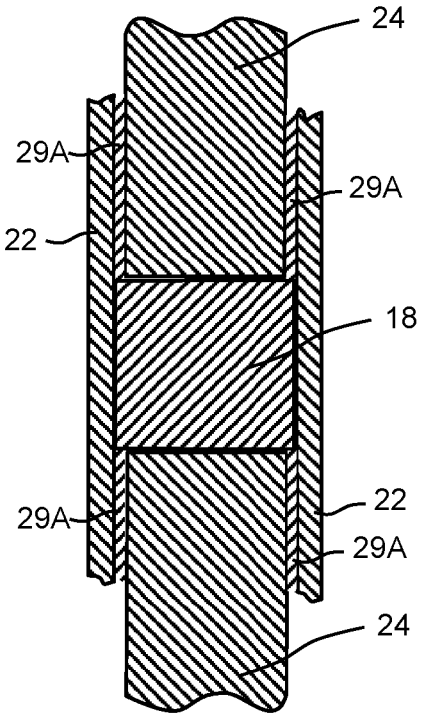
FIG. 3 shows a sectional view from below of an enlarged detail in the region of the connection between a vertical bar and adjacent horizontal connecting bars and filling elements of the fence/railing/gate element shown in FIG. 1.

FIG. 3 shows a possible installation of the filling elements 24 between vertical bars 18 and horizontal connecting bars 22. In this embodiment, the filling elements 24 are clamped between the connecting bars 22 by inserting, e.g., rubber elements 29A or other sealing materials 29A between the filling elements 24 and the horizontal connecting bars 22 or the vertical bars 18.

Figure 4:
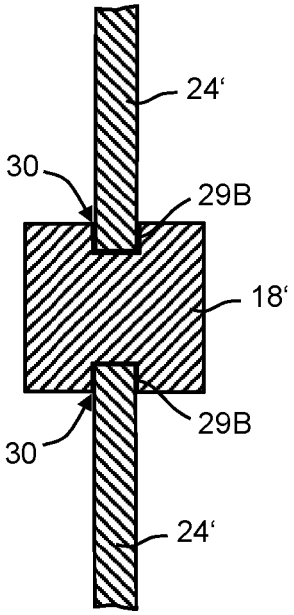
FIG. 4 shows a sectional view from below of an enlarged detail in the region of the connection between a vertical bar and adjoining filling elements of an alternative embodiment according to the invention of the fence/railing/gate element shown in FIG. 1.

FIG. 4 shows another embodiment in which the filling elements 24' are formed to be thinner than in the exemplary embodiment illustrated in FIG. 3, e.g. as glass panes or aluminum or plastic plates. These filling elements 24' are pushed into grooves 30 of the vertical bars 18'. The filling elements 24' can be secured in these grooves 30, e.g. by clamping with sealing material 29B or rubber elements 29B, by gluing, screwing or riveting. In this embodiment, the horizontal connecting bars 22 are dispensable and therefore not illustrated in FIG. 4.

Figure 5:
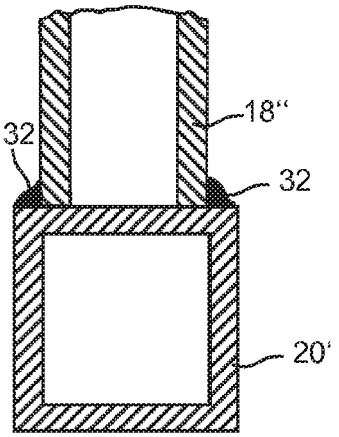
FIG. 5 shows a lateral sectional view of an enlarged detail in the region of the connection between the lower support profile and a vertical bar of the fence/railing/gate element shown in FIG. 1 according to an alternative configuration to FIG. 2.

FIG. 5 shows an alternative possibility—instead of the embodiment shown in FIG. 2—of connecting a vertical bar 18", formed as a rectangular tube, to a lower support profile 20', likewise formed as a rectangular tube. The rectangular tube of the vertical bar 18" is welded to the lower support profile 20' thereby forming weld seams 32.

In an alternative embodiment, the vertical bars 18 are formed to be solid, while the lower support profile 20' is formed as a tube. Conversely, in another alternative embodiment, the lower support profile 20 is solid, while the vertical bars are tubes.

In these alternative embodiments, too, the connections between the lower support profile and vertical bars can be formed by weld seams.

Figure 6:
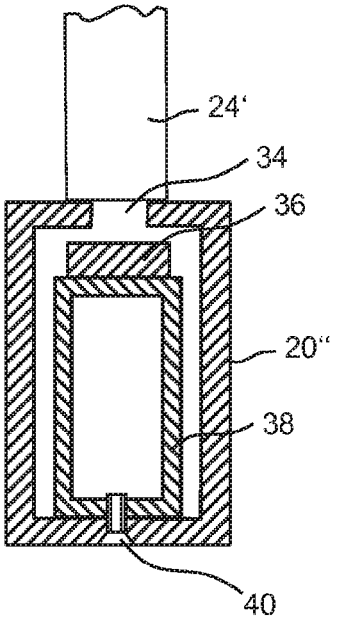
FIG. 6 shows a lateral sectional view of an enlarged detail in the region between the lower support profile and a filling element arranged thereabove according to a preferred embodiment of the invention.

FIG. 6 shows an alternative configuration of the lower support profile 20", which supports translucent glass plates or translucent plastic plates as filling elements 24'. The support profile 20" is formed as a rectangular steel tube with slots 34, which are located on the upper side of the support profile 20", as illustrated in FIG. 7, which shows a view from above of the support profile 20" illustrated in FIG. 6—but without filling elements 24'.

Inside this support profile 20", LED strips 36 are arranged which are mounted, e.g. by gluing, on a support body 38, in particular a rectangular tube, made of plastic, in particular PVC. The arrangement of LED strip 36 and support body 38 is pushed laterally into the support profile 20" and screwed to the support profile 20" by means of screws 40, in particular countersunk screws. In this way, the translucent filling elements are illuminated 24' from below and diffusely emit the fed light to the surroundings via their lateral surfaces.

In this embodiment, there are holes in the lateral posts 12, 14 which are located at the level of the lower support profile 20" and through which electrical lines are led to the LED strips 36.

Figure 7:
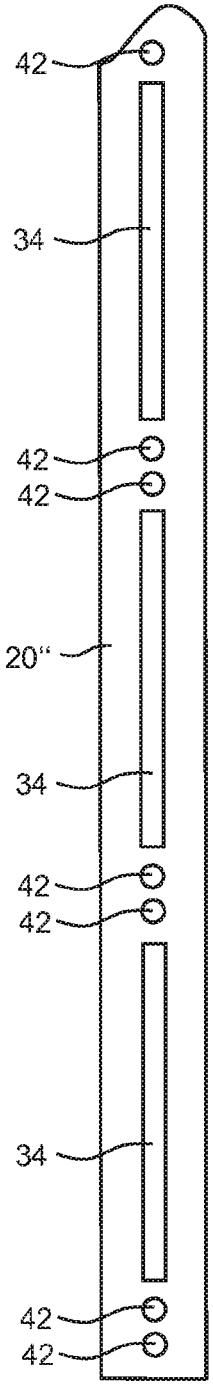
FIG. 7 shows a view from above of the lower support profile in a configuration according to FIG. 6.

FIG. 7 shows drain holes 42 next to the slots 34, through which liquid that has entered during a galvanizing process can drain off again. These drain holes 42 are preferably located in the region of the vertical bars 18", which are formed as pipes, so that liquid—which accumulates in the vertical bars 18" during the galvanizing process—can drain off again at the end of this process.

Figure 8:
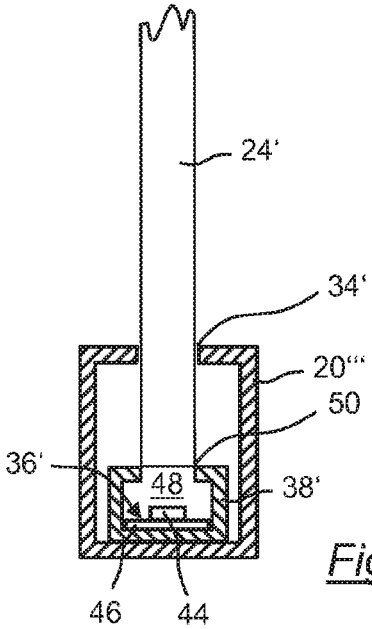
FIG. 8 shows a lateral sectional view of an enlarged detail in the region between the lower support profile and a filling element arranged thereabove according to another preferred embodiment of the invention.

FIG. 8 shows another alternative configuration of the lower support profile 20". In this configuration, the slot 34' is wider than the translucent filling element 24' which, e.g., is formed as tempered glass (Einscheibensicherheitsglas, ESG) or as translucent plastic plate. Therefore, the filling element 24' is embedded in the support profile.

Within the support profile 20'" there is a support body formed as a C-profile 38' which is attached to the bottom part of the support profile 20'". The C-profile is open at the top. Within the C-profile, there is a LED strip 36' with a multiplicity of LEDs 44 mounted on a circuit board 46. This LED strip 36' is encapsulated in the C-profile with epoxy resin 48 which extends up to the upper edge 50 of the C-profile. The translucent filling element 24' rests with its lower edge or, respectively, side surface on the epoxy resin 48, so that light can enter directly from the epoxy resin 48 irradiated by the LEDs 44 into the translucent filling element 24'.

Figure 9:
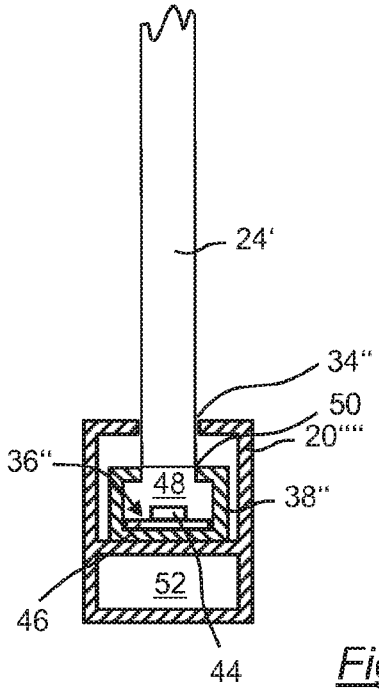
FIG. 9 shows a lateral sectional view of an enlarged detail in the region between the lower support profile and a filling element arranged thereabove according to another preferred embodiment of the invention.

FIG. 9 shows another alternative configuration of the lower support profile 20'". In this configuration, the slot 34" is also wider than the translucent filling element 24', which in turn is designed, for example, as ESG (tempered glass) or as a translucent plastic plate. The filling element 24' is therefore embedded into the support profile.

Within the support profile 20'" there is again a support body 38" formed as a C-profile which is attached to an intermediate part of the support profile 20"". The C-profile is again open at the top. Within the C-profile, there is an LED strip 36" with a multiplicity of LEDs 44 mounted on a circuit board 46. This LED strip 36' is encapsulated in the C-profile with epoxy resin 48 which extends to the upper edge 50 of the C-profile. The translucent filling element 24' in turn rests with its lower edge or, respectively, side surface on the epoxy resin 48 so that light from the epoxy resin 48 irradiated by the LEDs 44 can enter directly into the translucent filling element 24'.

The support profile 20"" according to FIG. 9 differs from the support profile 20'" according to FIG. 8 in that it has a channel 52 in the lower area which is used to accommodate voltage supply lines and/or data lines. Via these lines, sensors can be supplied with power and data of the sensors can be send to a control unit or control module. The channel 52 can advantageously be provided in its lower area with slots for the drainage of rainwater.

Overall, the invention therefore makes it possible to provide an easy-to-install fence or railing as well as easy-to-install gates which, depending on the embodiment, are used as privacy screens, wind protection, property boundaries, fall protection and/or for visual appearance.

Reference list:

| | |
|---|---|
| 10 | Fence/railing/gate elements |
| 12 | post |
| 14 | post |
| 16 | base frame |
| 18, 18', 18" | vertical bar |
| 20, 20', 20", 20'", 20"" | lower support profile |
| 22 | horizontal connecting bar |
| 24, 24' | filling element |
| 26 | base plate |
| 28 | base plate |
| 30 | grooves |
| 32 | weld seam |
| 34, 34', 34" | slot |
| 36, 36', 36" | LED strip |
| 38, 38', 38" | support body |
| 40 | screw |
| 42 | drain hole |
| 44 | LED |
| 46 | circuit board |
| 48 | epoxy resin |
| 50 | upper edge |
| 52 | channel |

The invention claimed is:

1. A fence/railing/gate element comprising a base frame that comprises a multiplicity of vertical bars, one or more horizontal connecting bars, and a lower support profile, wherein the vertical bars are arranged adjacent to one another and are connected to the lower support profile and to the one or more horizontal connecting bars, wherein the lengths of each vertical bar is greater than the horizontal distance that is between two adjacent vertical bars of the multiplicity of vertical bars, wherein the fence/railing/gate element further comprises flat filling elements, such that between each two adjacent vertical bars, one of the flat filling elements is inserted for filling a space between two adjacent vertical bars, wherein the flat filing elements are formed as plates, each plate having a horizontal cross-section being defined by an intersection of a horizontal plane through the entire filling element, said horizontal cross-section being of rectangular shape, wherein said rectangular shape is defined by two long edges and two short edges, wherein each short edge is arranged frontally opposite a side of a respective adjacent vertical bar in such a manner that the short edge lies within the area defined by the width of said side of the adjacent vertical bar, wherein said horizontal cross-section is entirely arranged in the space between two adjacent vertical bars, wherein the height of each flat filling element is greater than its width—measured in the direction of the longitudinal extent of the lower support profile, wherein the lower support profile is arranged vertically below the flat filling elements and an entire top end of each flat filling element is open, wherein the base frame is constructed in such a manner that the flat filling elements can be inserted vertically from above into the spaces between each two adjacent vertical bars, wherein the lower support profile is provided with light sources, wherein the lower support profile is formed as a rectangular tube with slots extending in the longitudinal direction of the tube and arranged on the upper side thereof in the region of the flat filling elements, wherein the flat filling elements are translucent and comprise lower narrow sides, and wherein the light sources are strip light sources arranged in such a manner within the lower support profile that light can be fed in the flat filling elements via the lower narrow sides of the flat filling elements, wherein the light is diffusely scattered on the surfaces of the flat filling elements, such that the flat filling elements are illuminated from below and diffusely emit the fed light to the surroundings via lateral surfaces of the flat filling elements and such that the flat filling elements glow over entire surfaces of the flat filling elements.

2. The fence/railing/gate element according to claim 1, wherein the base frame and the flat filling elements are made of different materials.

3. The fence/railing/gate element according to claim 1, wherein the base frame and the flat filling elements are made of the same materials.

4. The fence/railing/gate element according to claim 1, wherein the material of the base frame is or includes steel, powder-coated galvanized steel, stainless steel, aluminum, powder-coated aluminum, plastics, metal, composite material, bamboo or, respectively, bamboo-plastic composite material or wood or, respectively, wood-plastic composite material, and wherein the material of the flat filling elements is or includes wood, glass, aluminum, plastics, composite material or bamboo or, respectively, bamboo-plastic composite material or wood or, respectively, wood-plastic composite material, HPL, pure plastics, rocks or stone material, and/or carbon material.

5. The fence/railing/gate element according to claim 1, wherein sealing material and/or rubber elements are arranged between the one or more horizontal connecting bars and the flat filling elements.

6. The fence/railing/gate element according to claim 1, wherein sealing material and/or rubber elements are arranged between the vertical bars and the flat filling elements.

7. The fence/railing/gate element according to claim 1, wherein the vertical bars have grooves for guiding the flat filling elements, wherein the widths of the grooves are adapted to the thicknesses of the flat filling elements.

8. The fence/railing/gate element according to claim 7, wherein the grooves are provided with sealing material and/or rubber elements.

9. The fence/railing/gate element according to claim 1, wherein one or more of the vertical bars and the one or more horizontal connecting bars are provided with light sources.

10. The fence/railing/gate element according to claim 1, wherein between two outer vertical bars of the multiplicity of vertical bars and a respective nearest end of the lower support profile there is a distance which corresponds to the distance between the two outer vertical bars.

11. The fence/railing/gate element according to claim 1, wherein two outer vertical bars of the multiplicity of vertical bars are fastened to respective ends of the lower support profile.

12. The fence/railing/gate element according to claim 1, wherein one or more of the vertical bars, the lower support profile and the one or more horizontal connecting bars are formed round, angular or as a special profile as a hollow body or solid made of solid material.

13. A fence, railing or gate with fence/railing/gate elements according to claim 1, wherein each fence/railing/gate element is mounted between two posts provided laterally of each element.

14. The fence or railing according to claim 13, wherein the posts have base plates.

* * * * *